US006592199B2

(12) United States Patent
Endo

(10) Patent No.: US 6,592,199 B2
(45) Date of Patent: Jul. 15, 2003

(54) PRINTING WITH MISSING DOT TESTING

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/153,876

(22) Filed: May 24, 2002

(65) Prior Publication Data

US 2002/0180824 A1 Dec. 5, 2002

(30) Foreign Application Priority Data

May 30, 2001 (JP) ..... 2001-161877

(51) Int. Cl.[7] ..... B41J 29/393
(52) U.S. Cl. ..... 347/19
(58) Field of Search ..... 347/19, 14, 10–12, 347/6, 5, 20, 9, 41, 37, 15, 43, 47, 40; 358/298

(56) References Cited

U.S. PATENT DOCUMENTS 6,142,604 A * 11/2000 Kanda et al. ..... 347/41
6,158,834 A * 12/2000 Kato et al. ..... 347/9

* cited by examiner

*Primary Examiner*—Raquel Yvette Gordon
*Assistant Examiner*—Charles W. Stewart, Jr.
(74) *Attorney, Agent, or Firm*—Sughrue Mion, PLLC

(57) ABSTRACT

Performing an ejection testing method for nozzles in accordance with the present invention makes it possible to determine whether a plurality of nozzles contain inoperative nozzles incapable of ejecting ink drops, thus allowing the presence or absence of such inoperative nozzles to be confirmed without receiving test data for each of the nozzles.

15 Claims, 13 Drawing Sheets

First Embodiment

First Embodiment

Second Embodiment

First Nozzle Group (5 KHz)

Second Nozzle Group (3.3 KHz)

Third Nozzle Group (2 KHz)

Fourth Nozzle Group (1.4 KHz)

Nozzle Detection Signals and Second-order Harmonics

Chronological Binary Data of First Nozzle Group (5 KHz Component)

Chronological Binary Data of Second Nozzle Group (3.3 KHz Component)

Chronological Binary Data of Third Nozzle Group (2 KHz Component)

Chronological Binary Data of Fourth Nozzle Group (1.4 KHz Component)

Chronological Binary Data of First Nozzle Group (5 KHz Component)

Chronological Binary Data of Second Nozzle Group (3.3 KHz Component)

Chronological Binary Data of Third Nozzle Group (2 KHz Component)

Chronological Binary Data of Fourth Nozzle Group (1.4 KHz Component)

PRINTING WITH MISSING DOT TESTING

BACKGROUND OF THE INVENTION

1. Field of the Invention

The present invention relates to a technique for detecting the ejection of ink drops by a printing apparatus.

2. Description of the Related Art

In an ink-jet printer, ink drops are ejected from a plurality of nozzles to print images. The print head of an ink-jet printer is provided with a plurality of nozzles, some of which are occasionally plugged and rendered incapable of ejecting ink drops. This is caused by an increase in ink viscosity, the entry of gas bubbles, or other factors. Such inability to eject ink drops produces images with missing dots and has an adverse effect on image quality. The ejection of ink drops should therefore be monitored before or during printing.

Detection methods based on the use of light have been proposed as a means of monitoring the ejection of ink drops. Such detection methods allow the operation of each nozzle to be confirmed by moving the print head in order to dispose the nozzles at specific positions, and causing each nozzle to eject ink drops to block light from a detection device.

However, this testing operation requires that detection data be acquired and processed for each nozzle. The resulting drawback is that considerable time is required to acquire and process such detection data.

SUMMARY OF THE INVENTION

Accordingly, an object of the present invention is to detect inoperative nozzles without acquiring detection data for each nozzle.

In order to attain the above and the other objects of the present invention, there is provided a method for testing ejections of ink drops with a print head including a nozzle row having a plurality of nozzles. The testing method comprises the steps of: generating a light beam concurrently intersecting a plurality of paths of ink drops ejected from N target nozzles for the testing, N being an integer of 2 or more; providing the N target nozzles with drive signals to eject ink drops; generating detection pulses in response to blockage of the light beam by the ejected ink drops; and detecting presence or absence of inoperable nozzle incapable of ejecting ink drops by analyzing the detection pulses.

In the printing method of the present invention, the presence of the inoperative nozzle can be detected without acquiring detection data for each nozzle. Because each of the plurality of nozzles is detected and it is determined whether the each plurality of nozzles contain inoperative nozzles.

In the printing method of the present invention, the testing method further comprising the steps of updating the target nozzles by moving at least one of the print head and the light beam; and repeating the above mentioned steps until the testing is performed on all the plurality of nozzles.

In a preferred method of the present invention, the step (d) includes the step of determining presence or absence of the inoperative nozzle among the N target nozzles if a value of a detection pulse is less than a predetermined first threshold value.

This configuration can be readily adapted to a printing device because the presence or absence of inoperative nozzles among the target nozzles can be established by comparing detection pulses with a predetermined threshold value.

In a preferred embodiment of the invention, the step (b) includes the step of setting a constant frequency for the drive signals; and the step (d) includes the steps of generating a nozzle detection signal by filtering out a component of the constant frequency from the detection pulses; and determining presence or absence of the inoperative nozzle among the N target nozzles if a value of the nozzle detection signal is less than a predetermined second threshold value.

This arrangement makes it possible to establish the presence or absence of inoperative nozzles with greater accuracy because only signals generated in accordance with the ejection of ink drops can be extracted.

In a preferred embodiment of the invention, the testing method further comprises the step of cleaning a nozzle row including the detected inoperative nozzle This arrangement makes it possible to reduce the consumption of ink during nozzle cleaning because the missing of dots (the presence of inoperative nozzles) can be prevented by cleaning only part of the plurality of nozzles provided to the print head.

In a preferred embodiment of the invention, sequentially providing each of the N target nozzles with the drive signals one by one if the inoperative nozzle is detected among the N target nozzles; generating detection pulses in response to blockage of the light beam by the ink drops ejected from each of the N target nozzles; and identifying the inoperative nozzle in response to the detection pulses.

This arrangement makes it possible to identify the inoperative nozzles among other nozzles, allowing printing to be continued by, supplementing the inoperative nozzles with other nozzles when missing dots are detected during printing, for example.

In a preferred embodiment of the invention, the step (b) includes the steps of setting N types of mutually different frequencies for the drive signals; and providing each of the N target nozzles with each of the N types of mutually different frequencies, respectively; and the step (d) includes the steps of filtering out N components of the N types of mutually different frequencies from the detection pulses generating nozzle detection signals as chronological data for each of the N components; and identifying the inoperative nozzle among the N target nozzles by comparing an order of the nozzle detection signals in the chronological data.

This arrangement makes it possible to identify inoperative nozzles without repeating detection of each tested nozzle for the presence of inoperative nozzles.

In a preferred embodiment of the invention, the N types of ejection frequencies are set such that any multiples of the N types of mutually different frequencies is different from any of the N types of mutually different frequencies.

This arrangement makes it possible to avoid situations in which the frequency of a nozzle detection signal coincides with the higher harmonic of the nozzle detection signal for a nozzle belonging to a different nozzle group. This allows inoperative nozzles to be detected with higher accuracy by suppressing higher-harmonic noise.

The present invention can be realized in various forms such as a method and apparatus for printing, a method and apparatus for producing print data for a printing unit, and a computer program product implementing the above scheme.

These and other objects, features, aspects, and advantages of the present invention will become more apparent from the following detailed description of the preferred embodiments with the accompanying drawings.

DESCRIPTION OF THE PREFERRED EMBODIMENT

The present invention is explained in the following sequence based on embodiments.

Figure 1:
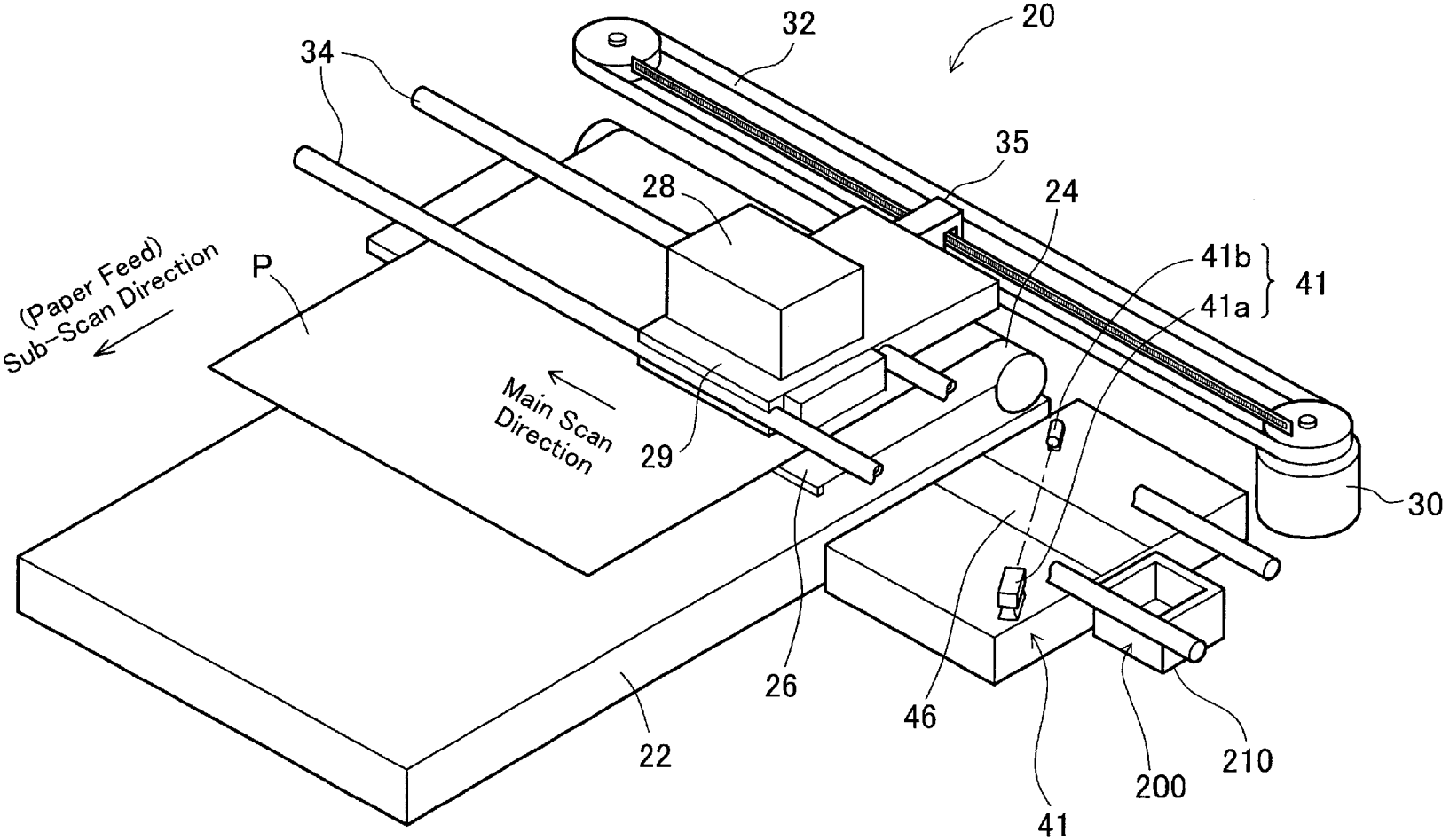
FIG. 1 is a schematic perspective view depicting the structure of the principal components constituting a color ink-jet printer 20 as an embodiment of the present invention.

A. Apparatus Structure
B. Structure and Operating Principle of Ink Drop Detector
C. Structure and Operation of Cleaning Mechanism
D. First embodiment
E. Second embodiment
F. Modifications A. Apparatus Structure FIG. 1 is a schematic perspective view depicting the structure of the principal components constituting a color ink-jet printer 20 as a embodiment of the present invention. The printer 20 comprises a paper stacker 22, a paper feed roller 24 driven by a step motor (not shown), a platen plate 26, a carriage 29, a step motor 30, a traction belt 32 driven by the step motor 30, guide rails 34 for the carriage 29, and a linear encoder 35 for measuring the position of the carriage 29 in the main scan direction. A print head 28 provided with numerous nozzles is mounted on the carriage 29. The step motor 30 is also referred to as a "carriage motor."

A detection pulse generator 41 is mounted in a standby position on the carriage 29 on the right side in FIG. 1. The detection pulse generator 41, which comprises a light emitter 41*a* and a light receiver 41*b*, detects ink drops with the aid of light. Following is a detailed description of the manner in which the drops are detected by the detection pulse generator 41.

Printing paper P is retrieved from the paper stacker 22 by the paper feed roller 24 and transported in the sub-scan direction across the surface of the platen plate 26. The carriage 29 is pulled by the traction belt 32, which is itself driven by the step motor 30, and is propelled along the guide rails 34 in the main scan direction. The position of the carriage 29 in the main scan direction is measured by the linear encoder 35. The main scan direction is perpendicular to the sub-scan direction.

Figure 2:
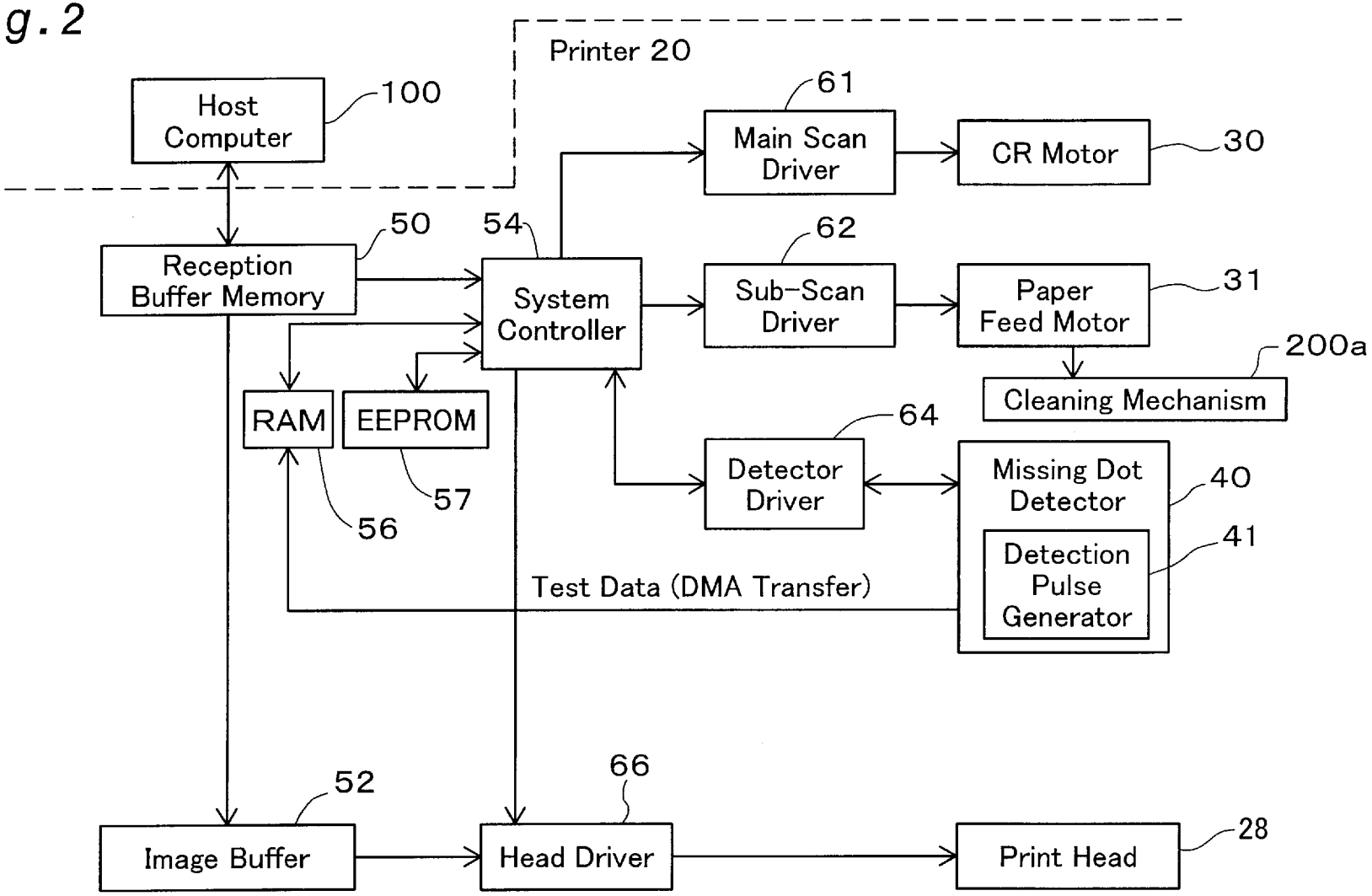
FIG. 2 is a block diagram depicting the electrical structure of the printer 20.

FIG. 2 is a block diagram depicting the electrical structure of the printer 20. The printer 20 comprises a reception buffer memory 50 for receiving signals from a host computer 100, an image buffer 52 for storing print data, a system controller 54 for controlling the operation of the entire printer 20, a RAM 56, and an EEPROM 57, a rewritable nonvolatile memory.

The following drivers are connected to the system controller 54: a main scan driver 61 for driving the carriage motor 30, a sub-scan driver 62 for driving a paper feed motor 31, a detector driver 64 for driving a missing dot detector 40 provided to the detection pulse generator 41, and a head driver 66 for driving the print head 28. The paper feed motor 31 is also used to drive the cleaning mechanism 200*a* described below.

The printer driver (not shown) of the host computer 100 establishes various parametric values for defining the printing operation on the basis of the printing mode (high-speed printing mode, high-quality printing mode, etc.) specified by the user. Based on these parametric values, the printer driver generates print data for performing printing according to the specified printing mode and forwards these data to the printer 20. The data thus forwarded are temporarily stored in the reception buffer memory 50. In the printer 20, the system controller 54 reads the necessary information from among the print data stored in the reception buffer memory 50 and sends a control signal to each driver on the basis of this information.

The image buffer 52 stores print data for a plurality of color components obtained by a method in which the print data received by the reception buffer memory 50 are resolved for each color component. With the head driver 66, the print data for each color component from the image buffer 52 are read in accordance with the control signal from the system controller 54, and the nozzle array (also referred to as the "nozzle row") of each color provided to the print head 28 is driven in accordance with the result by being provided with a drive signal DRV. The driver 66 functions as the drive signal generator referred to in the claims.

The system controller 54 implements various functions of the computer programs stored in EEPROM 57, including the missing dot testing function and the adjustment function of the missing dot detector 40.

The computer program stored in EEPROM 57 is rewritable. The computer program can be supplied as a program stored on a computer-readable storage medium such as a floppy disk or a CD-ROM. The host computer 100 reads the computer program from the storage medium and forwards the program to the EEPROM 57 of the printer 20. The computer program stored in the EEPROM 57 is thus rewritten.

The storage medium used in the present invention can be a floppy disk, a CD-ROM, a magneto-optical disk, an IC card, a ROM cartridge, a punch card, printed matter with bar codes or other printed symbols, an internal computer storage device (RAM, ROM, or another type of memory), an external storage device, or another computer-readable medium.

B. Structure and Operating Principle of Ink Drop Detector

Figure 3:
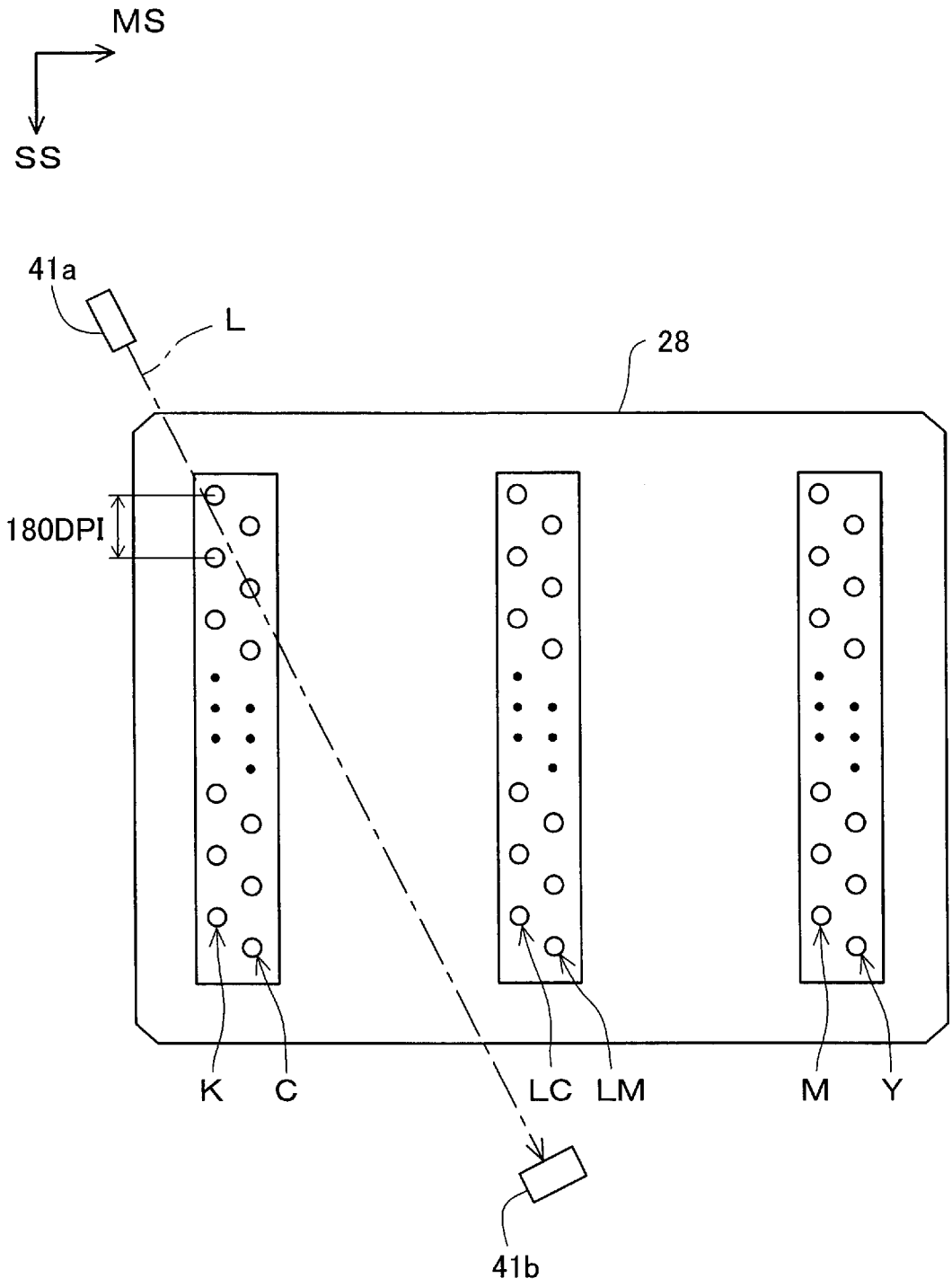
FIG. 3 is a diagram depicting the structure of an ink drop detector 41 and the operating principle of the testing method (technique for testing the movement of drops through the air)

FIG. 3 is a diagram depicting the structure of the ink drop detector 41 and the operating principle of the testing method (technique for testing the movement of drops through the air). FIG. 3, which is a view of the print head 28 from below, depicts six-color nozzle array of the print head 28 together with the light emitter 41*a* and light receiver 41*b* of the detection pulse generator 41.

The bottom surface of the print head 28 is provided with a black ink nozzle row K for ejecting black ink, a dark cyan ink nozzle row C for ejecting cyan ink, a light cyan ink nozzle row LC for ejecting light cyan ink, a light magenta ink nozzle row LM for ejecting light magenta ink, a magenta ink nozzle row M for ejecting dark magenta ink, and a yellow ink nozzle row Y for ejecting yellow ink.

The nozzles of each of the plurality of nozzle rows are aligned in the sub-scan direction SS. During printing, ink drops are ejected by the nozzles while the print head 28 moves together with the carriage 29 (FIG. 1) in the main scan direction MS.

The light emitter 41*a* is a laser diode for emitting a light beam L with an outside diameter of about 1 mm or less. The orientation of the light emitter 41*a* and light receiver 41*b* can be adjusted such that the direction of propagation of laser light L is somewhat inclined relative to the sub-scan direction SS.

C. Structure and Operation of Cleaning Mechanism

Figure 4:
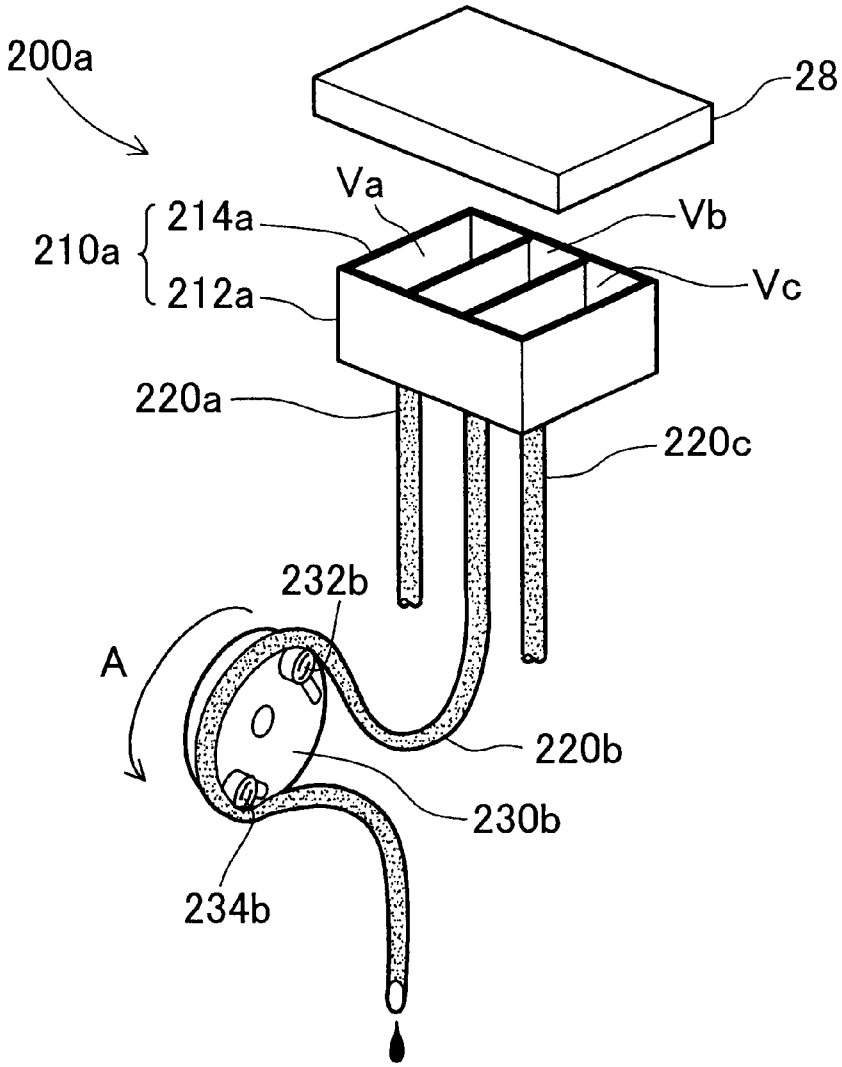
FIG. 4 is a schematic depicting the structure of the cleaning mechanism 200*a;*

FIG. 4 is a schematic depicting the structure of the cleaning mechanism 200*a*. The cleaning mechanism 200*a* comprises a head cap 210*a*; hoses 220*a*, 220*b*, and 220*c*; and pump roller 230*b* for the hose 220*b*. In FIG. 4, the hoses 220*a* and 220*c* are shown only partially, and their pump rollers are not shown at all.

The space inside the head cap 210*a* is separated into three suction chambers Va, Vb, and Vc, as shown in FIG. 4. When the head cap 210*a* is lifted and pressed against the bottom surface of the print head 28, the suction chamber Va forms a closed space for covering the nozzle rows K and C (FIG. 3), the suction chamber Vb forms a closed space for covering the nozzle rows LC and LM, and the suction chamber Vc forms a closed space for covering the nozzle rows M and Y. The hoses 220*a*, 220*b*, and 220*c* are connected to the suction chambers Va, Vb, and Vc of the head cap 210*a*, respectively. The other end of the hose 220*b* is connected to the pump roller 230*b*, respectively. The other hoses 220*a*, 220*c* are also connected to similar pump rollers (not shown), respectively. The pump rollers can be independently connected to the paper feed motor 31 (FIG. 2) by means of individual clutches (not shown).

Two small rollers 232*b* and 234*b* are provided near the rim of the pump roller 230*b*. The hose 220*b* is wound around the two small rollers 232*b* and 234*b*. When the paper feed motor 31 is connected to the pump roller 230*b* and the roller is rotated in the direction of arrow A, the air inside the hose 220*b* is compressed by the small rollers 232*b* and 234*b*, and the closed space Vb inside the head cap 210*a* is thereby evacuated. As a result, ink is suctioned from the nozzles of the nozzle rows LC and LM in the print head 28, and is discharged into a waste ink collector (not shown) through the hose 220*b*. Once the ink has been cleared from the nozzle tip, fresh ink is fed to the nozzle from the ink cartridge.

The pump rollers for the hoses 220*a*, 220*c* are configured and operated in the same manner as the pump roller 230*b*. This arrangement allows the pump rollers to suction ink independently from each of three separate nozzle sets of K and C, LC and LM, and M and Y.

D. First Embodiment

Figure 5:
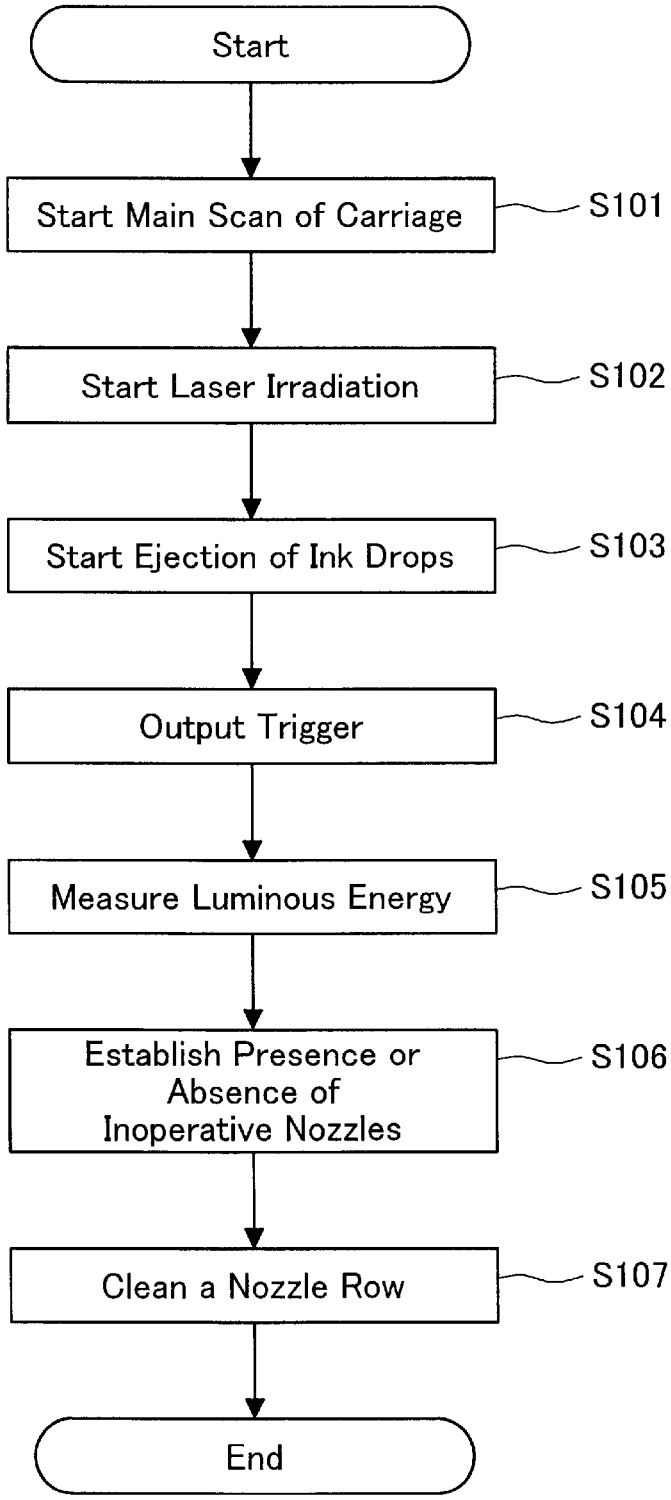
FIG. 5 is a flowchart depicting the procedure for detecting inoperative nozzles in accordance with the second embodiment of the present invention.

FIG. 5 is a flowchart depicting a procedure for detecting inoperative nozzles. According to this procedure, a nozzle row containing at least one inoperative nozzle is detected without determining whether each nozzle is operable or not. This procedure has the advantage that it can efficiently find a nozzle row which requires cleaning.

Upon receipt of a command from the system controller 54, the main scan driver 61 actuates the carriage motor 30 to move the carriage 29 in step S101. According to the missing dot testing procedure of the present embodiment, a plurality of target nozzles for testing is updated as the carriage 29 intermittently moves in a small distance in the main scan direction. The position of the carriage 29 is measured using the linear encoder 35. The measurement results are periodically sent to the missing dot detector 40 via the system controller 54 to determine the target nozzles.

The light emitter 41*a* starts emitting laser radiation in step S102.

The laser irradiation procedure is started in accordance with the measured value obtained for the position of the carriage 29. The laser irradiation procedure may, for example, be started with a timing that allows ink drops to be stably detected when at least one nozzle in the print head 28 reaches the vicinity of laser light L.

Figure 6:
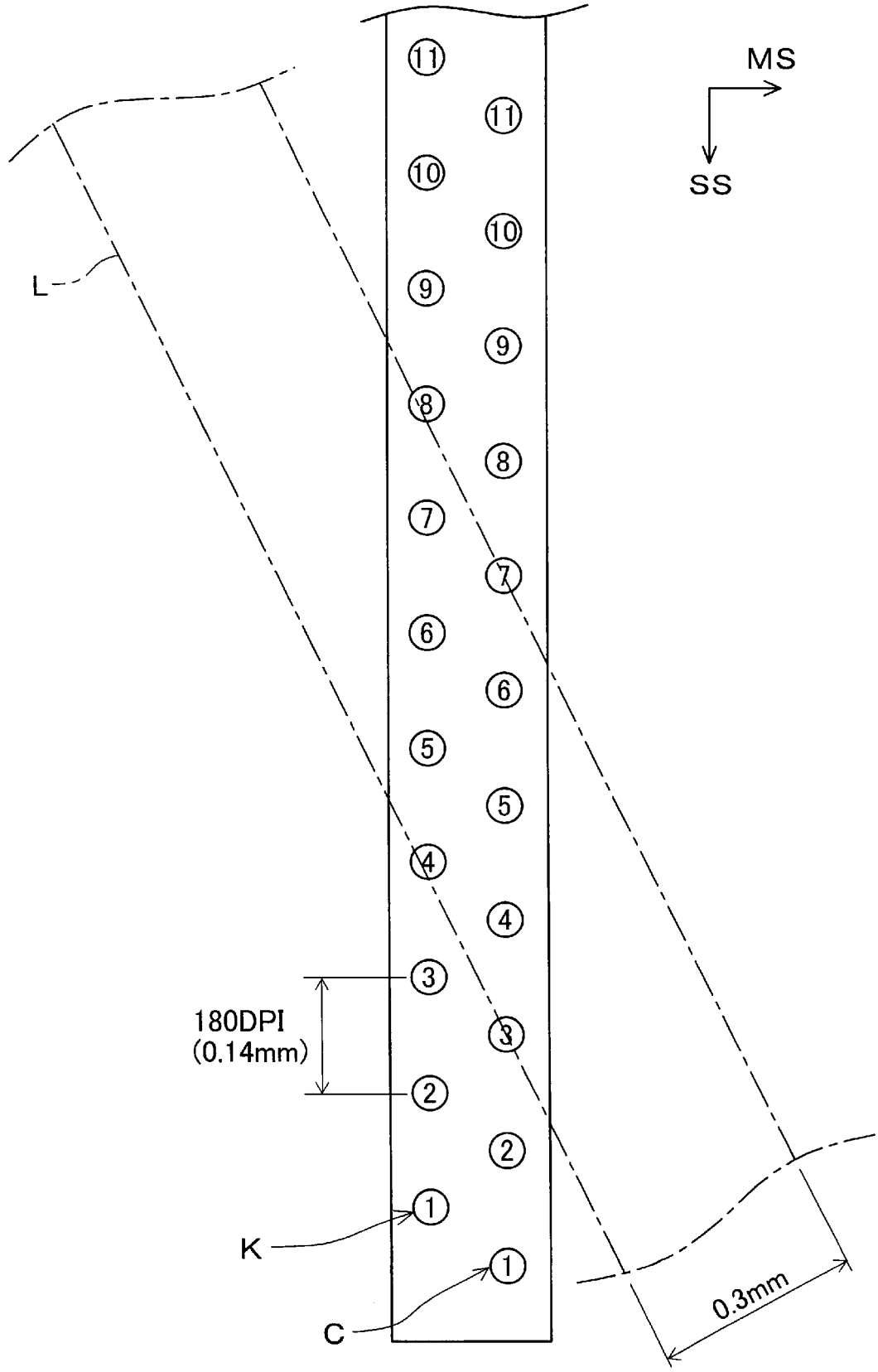
FIG. 6 is a diagram depicting the positional relation between the nozzles and laser light L according to the first embodiment of the present invention.

FIG. 6 is a diagram depicting the positional relation between the nozzles and laser light L according to the first embodiment of the present invention. The drawing depicts FIG. 3 in enlarged form and shows laser light L and the nozzles of the print head 28. Laser light L has a sensing area or effective area with a width of 0.3 mm. The term "sensing area" refers to an area in which the luminous energy of laser light L decreases to a level detectable by the detection pulse generator 41 when ink drops are ejected into this area. The sensing area accommodates ink drops ejected by three nozzles belonging to nozzle row C (nozzle Nos. 4–6). In this case, the three nozzles (nozzle Nos. 4–6) are the target nozzles. The print head 28 is stationary at this positional relation.

When the target nozzles (nozzle Nos. 4–6) start ejecting ink drops in step S103, the system controller 54 sends a measurement trigger to the missing dot detector 40 via the detector driver 64 (step S104). The missing dot detector 40 receives the output value of the light receiver 41*b* in accordance with the measurement trigger (step S105). The output value is converted from analog to digital format. The test data are directly sent to RAM 56 by means of Direct Memory Access (DMA) transfer and are stored at a predetermined address.

Figure 7:
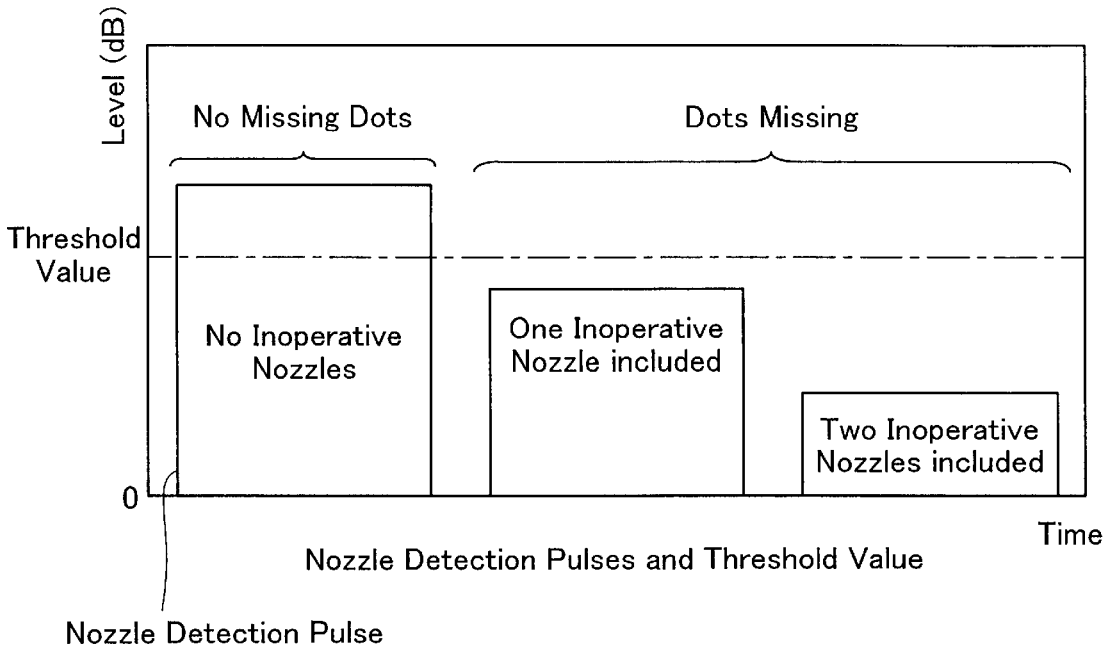
FIG. 7 is a diagram depicting the relation between the detection pulses for nozzles and a threshold value according to the first embodiment of the present invention.

The missing dot detector 40 determines in step S106 based on the test data read from RAM 56 whether the three target nozzles contain at least one inoperative nozzle. This determination is made by comparing luminous energy with the threshold value stored in EEPROM 57, as shown in FIG. 7. In the process, the missing dot detector 40 also identifies the nozzle row containing inoperative nozzles. In this embodiment, the missing dot detector 40 functions as the inoperative nozzle detector referred to in the claims.

Each threshold value may be determined in the following manner, for example. Each nozzle is first scanned to confirm that all the nozzles are in an operating condition. The reduction in luminous energy is then measured in a state in which ink drops are ejected from only two of the three target nozzles. A threshold value for each of a plurality of target nozzles can be established in accordance with the measured value. The threshold value may be set prior to shipment of the printer, or it may be set after the shipment. This threshold value corresponds to the first threshold value referred to in the claims.

Steps S103–106 are repeated again after the presence or absence of inoperative nozzles is established for the first set of target nozzles and the target nozzles are updated by moving the carriage 29. All the nozzles of the print head 28 can thus be checked. The main scan driver 61 and carriage motor 30 correspond to the unit for updating the target nozzles referred to in the claims.

In step S107, the cleaning mechanism 200*a* (FIG. 2) cleans the nozzle sets whose nozzle rows contain inoperative nozzles.

The first embodiment is thus advantageous in that less time is needed to acquire test data and that the amount of test data can be reduced because inoperative nozzles can be detected without the need to acquire test data for each nozzle.

Another feature of this embodiment is that nozzle rows having inoperative nozzles can be identified at the same time, making it possible to prevent missing dots by cleaning only some of the plurality of nozzles (in the present embodiment, only a set of nozzles) belonging to the print head. As a result, this approach is advantageous in that less ink is consumed during nozzle cleaning.

It is also possible to identify inoperative nozzles by allowing ink drops to be sequentially ejected from the plurality of target nozzles identified as containing inoperative nozzles. This is because identifying inoperative nozzles makes it possible, for example, to perform printing in a way in which the dots that were to be formed by the inoperative nozzles are supplemented by other nozzles. This supplementary action is disclosed in detail in JP 2000-263772A, the disclosure of which is hereby incorporated by reference for all purpose.

E. Second Embodiment

Figure 8:
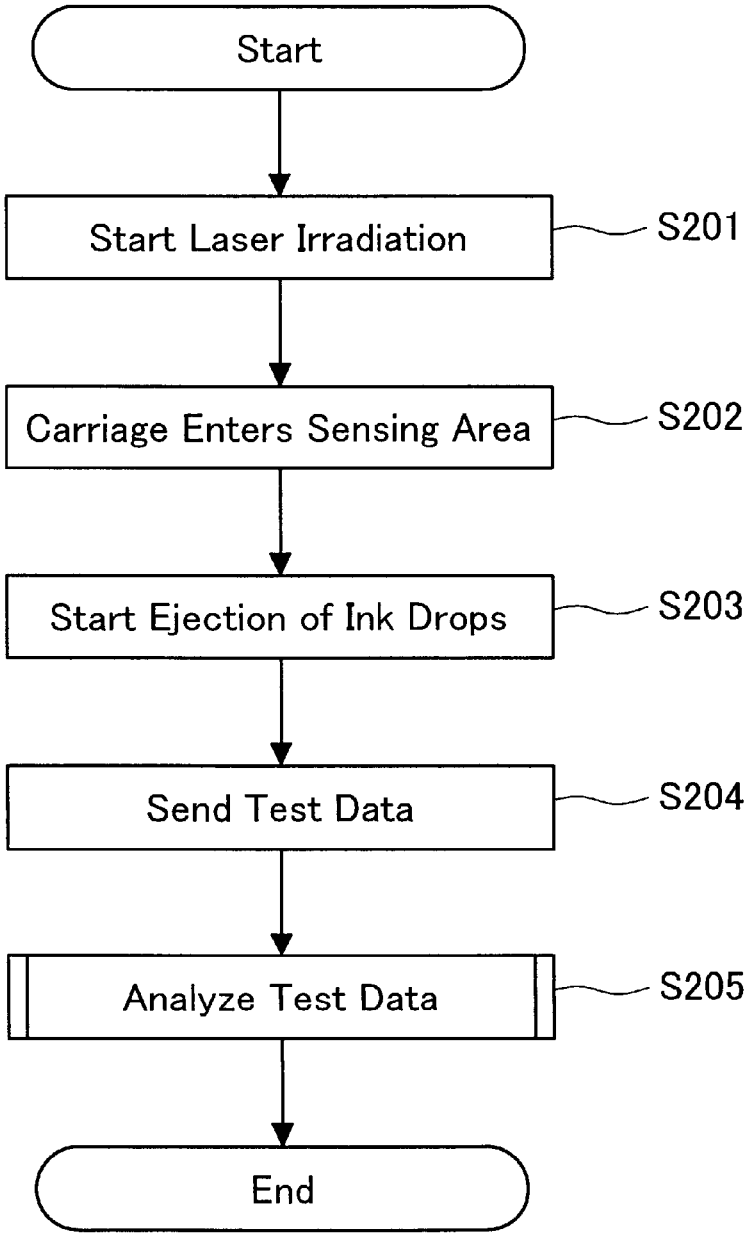
FIG. 8 is a flowchart depicting the procedure for identifying inoperative nozzles in accordance with a second embodiment of the present invention.

FIG. 8 is a flowchart depicting the procedure for identifying inoperative nozzles in accordance with the second embodiment. In this embodiment, inoperative nozzles can be identified without retesting the plurality of those target nozzles for which the presence or absence of inoperative nozzles have already been established, that is, without performing a detailed testing procedure in which ink drops are sequentially ejected from each of the plurality of target nozzles in order to identify the inoperative nozzles.

In steps S201 and S202, laser irradiation and the main scan of the carriage 29 are started in the same manner as in the first embodiment.

In step S203, the plurality of target nozzles start ejecting ink drops. According to the second embodiment, the head driver 66 defines a specific number of target nozzles in accordance with the position of the carriage 29 and causes these target nozzles to eject ink drops without stopping the print head 28. The other feature that distinguishes the second embodiment from the first embodiment is that the frequencies with which the ink drops are ejected by the target nozzles are different for each nozzle.

Figure 9:
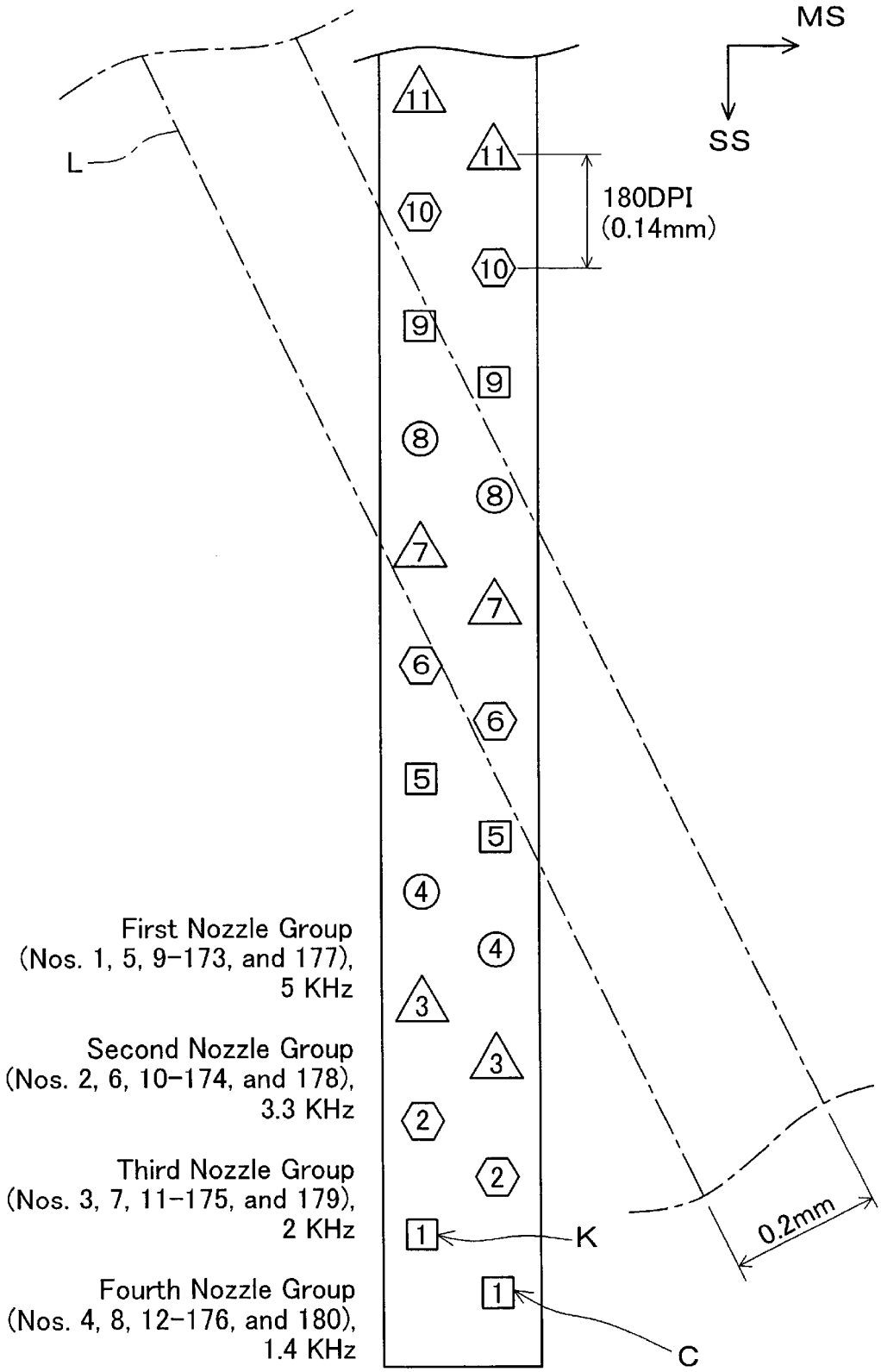
FIG. 9 is a diagram depicting the positional relation between laser light L and the plurality of nozzles for ejecting ink drops at mutually different frequencies in accordance with the second embodiment of the present invention.
Figure 10A:
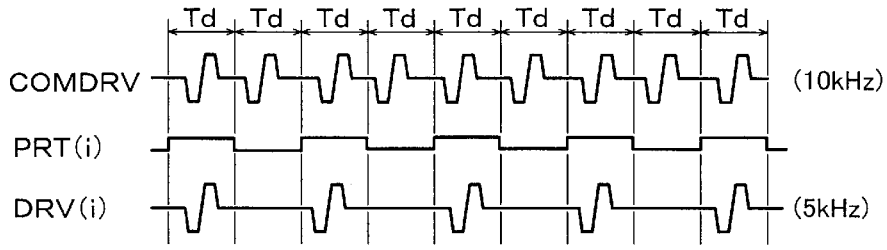
FIGS. 10A–10D are diagrams depicting a method for generating drive signals designed to cause ink drops to be ejected at mutually different constant frequencies.
Figure 10B:
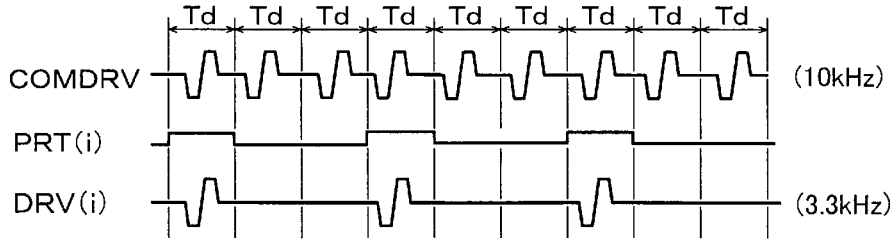
Figure 10C:
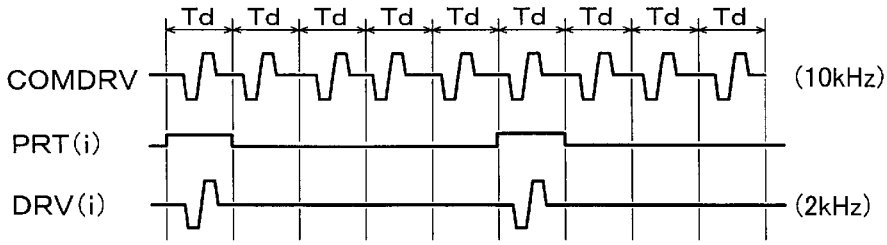
Figure 10D:
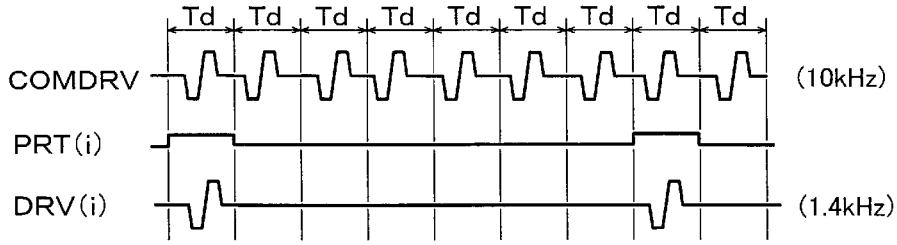

FIG. 9 is a diagram depicting the positional relation between laser light L and the plurality of nozzles for ejecting ink drops at mutually different frequencies in accordance with the second embodiment of the present invention. Each nozzle row comprises 180 nozzles. The nozzles of each nozzle row are divided into four nozzle groups, and the ink drops are ejected at frequencies that are different for each nozzle group.

In the example shown in the drawing, a first nozzle group consisting of nozzle Nos. 1, 5, 9–173, and 177 ejects ink drops at 5 kHz; a second nozzle group consisting of nozzle Nos. 2, 6, 10–174, and 178 ejects ink drops at 3.3 kHz; a third nozzle group consisting of nozzle Nos. 3, 7, 11–175, and 179 ejects ink drops at 2 kHz, and a fourth nozzle group consisting of nozzle Nos. 4, 8, 12–176, and 180 ejects ink drops at 1.4 kHz.

The nozzle arrangement and other parameters shown below are set so as to exclude situations in which the plurality of nozzles belonging to the same nozzle group within the same nozzle row are tested at the same time during the main scan of the print head 28.

(1) Arrangement of nozzles belonging to each nozzle group (2) Width of sensing area formed by laser light L (3) Angle between laser light L and nozzle row For example, the nozzles belonging to the first to fourth nozzle groups in the arrangement shown in FIG. 9 are arranged in a regular manner in the sub-scan direction, and a maximum of three nozzles (Nos. 6–8 in the drawing) are subject to testing, preventing situations in which a plurality of nozzles belonging to the same nozzle group are tested at the same time. It can also be seen that since each nozzle group is actuated at a different frequency, different types of frequencies are used to eject ink drops from the plurality of target nozzles.

FIGS. 10A–10D are diagrams depicting a method for generating drive signals DRV designed to cause ink drops to be ejected at mutually different constant frequencies. According to the second embodiment, drive signals DRV for causing some of the plurality of target nozzles to eject ink drops at mutually different constant frequencies are generated based on the original 10-kHz drive signal COMDRV. The drive signals DRV are generated as a result of the fact that the original drive signal COMDRV is switched on and off in accordance with a print signal PRT.

Specifically, the 5 kHz drive signal DRV for the first nozzle group can be generated by switching on the print signal PRT once every two cycles, the 3.3 kHz drive signal DRV for the second nozzle group can be generated by switching on the print signal PRT once every three cycles, the 2 kHz drive signal DRV for the third nozzle group can be generated by switching on the print signal PRT once every five cycles, and the 1.4 kHz drive signal DRV for the fourth nozzle group can be generated by switching on the print signal PRT once every seven cycles, as show in FIGS. 10A–10D, respectively.

Figure 11:
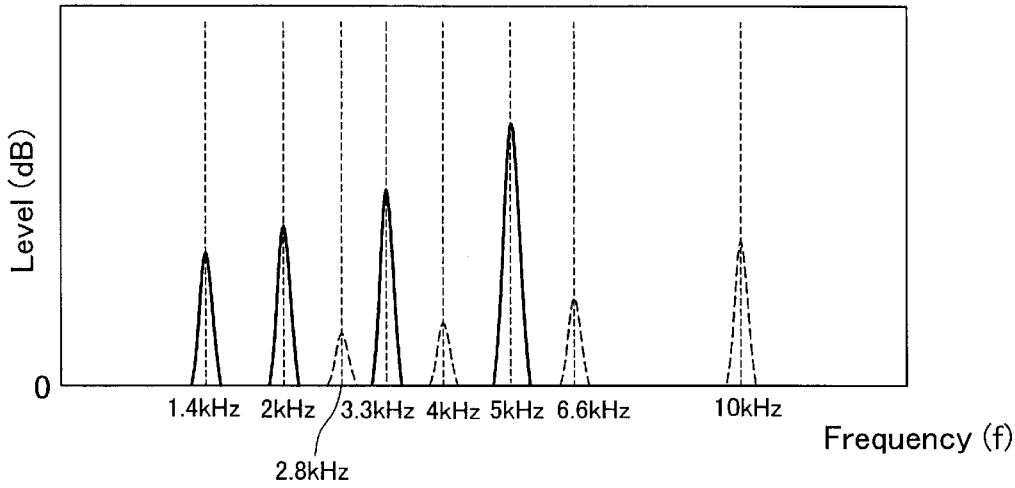
FIG. 11 is a diagram in which the detection pulses used in the second embodiment of the present invention are shown in frequency domain.

FIG. 11 is a diagram in which the detection pulses used in the second embodiment of the present invention are shown in frequency domain. The solid lines show the fundamental waves, which are the frequencies at which ink drops are ejected; and the dotted lines show the second harmonic of the frequencies at which the ink drops are ejected. Harmonics of the third and higher orders are not shown. It can be seen in the drawing that the second harmonic deviates from the fundamental frequency.

A plurality of types of ejection frequencies are thus set such that an integral multiple of an ejection frequency selected from the plurality of types of ejection frequencies is different from any other ejection frequency selected from the plurality of types of ejection frequencies. The reason that the fundamental frequency is set in this manner is that this approach makes it possible to reduce the likelihood of an erroneous identification based on higher-harmonic noise.

In step S204, the test data are sent as a DMA transfer to memory 56 and are stored at a specific address in the same manner as in the first embodiment above. The test data are analyzed by the system controller 54 to identify inoperative nozzles (step S205).

Figure 12:
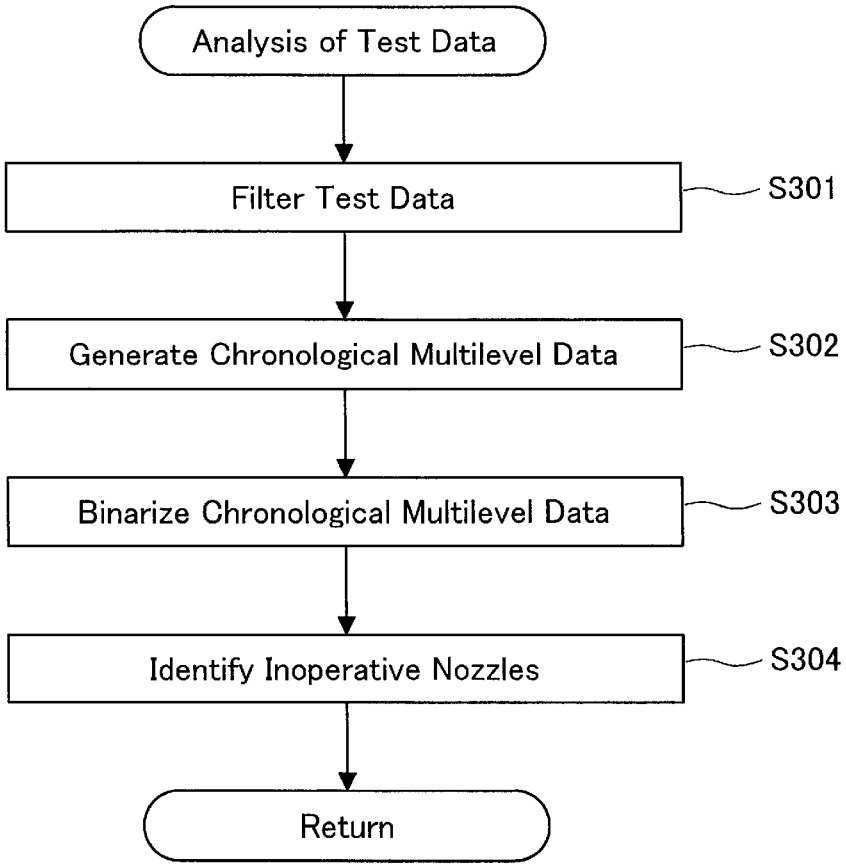
FIG. 12 is a flowchart depicting the method for analyzing detection pulses in accordance with the second embodiment of the present invention.
Figure 13A:
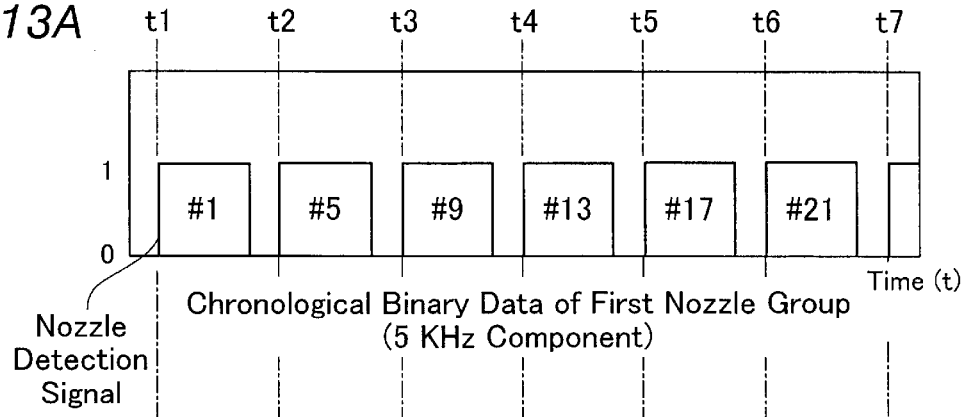
FIGS. 13A–13D are diagrams depicting chronological data divided by nozzle group.
Figure 13B:
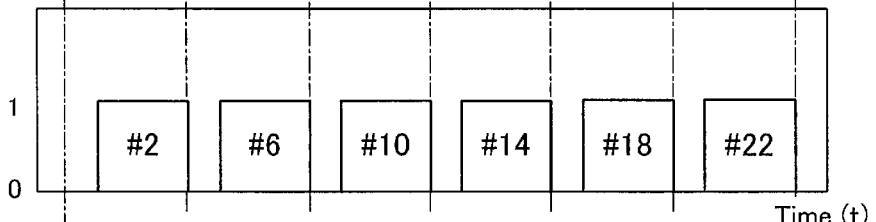
Figure 13C:
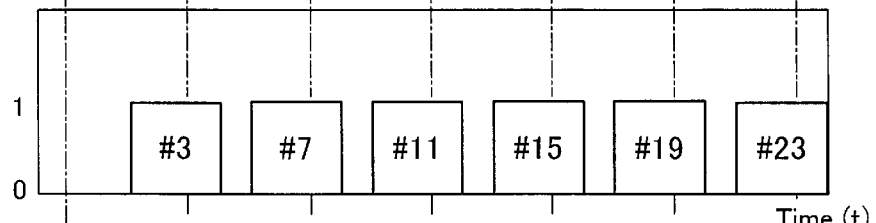
Figure 13D:
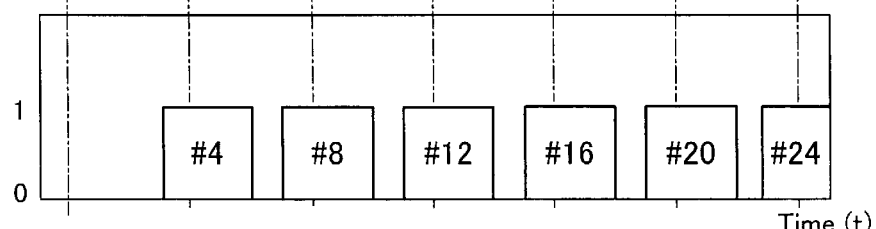
Figure 14A:
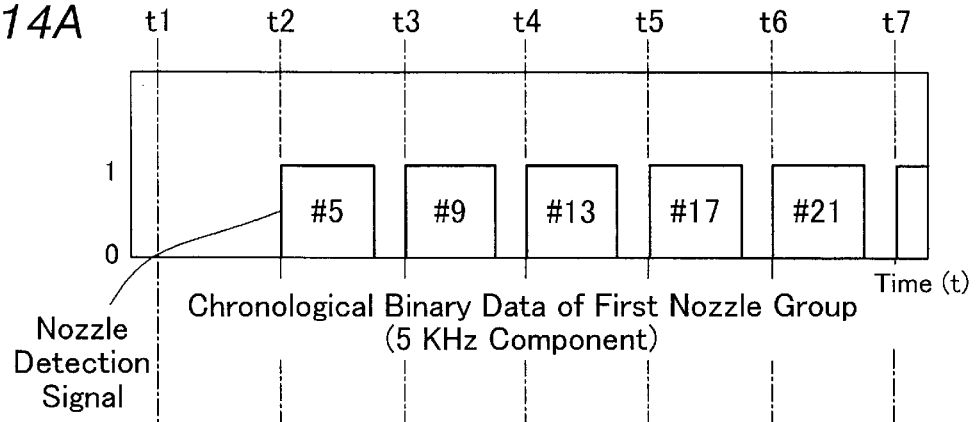
FIGS. 14A–14D are diagrams depicting chronological data divided by nozzle group.
Figure 14B:
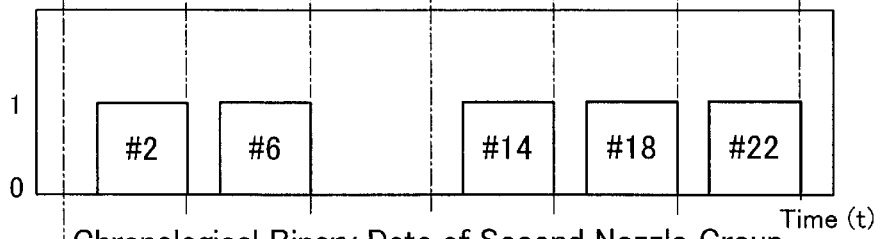
Figure 14C:
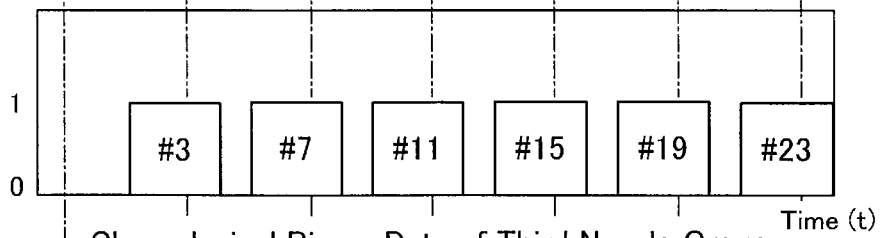
Figure 14D:
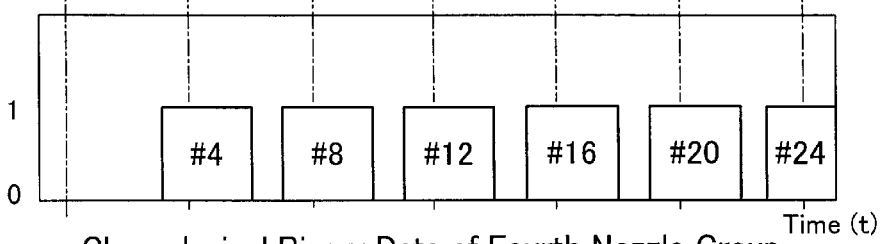

FIG. 12 is a flowchart depicting the specifics of analyzing test data in step S205. In step S301, the system controller 54 reads test data from memory 56 and filters these data. The filtering procedure is a digital routine for extracting data related to the frequency components that match the frequencies at which ink drops are ejected by each nozzle group. The filtering procedure is performed for each nozzle group frequency. The test data thus filtered are chronologically arranged, and chronological data are generated for each nozzle group (step S302). The chronological data are in the form of eight-bit multilevel data related to each nozzle group. The multilevel data are binarized in the subsequent step S303.

FIGS. 13A–13D are diagrams depicting chronological binary data divided by nozzle group. The numbers in the nozzle detection signals indicate corresponding nozzle numbers. In the example shown, the test data are divided into 5, 3.3, 2, and 1.4 kHz components (ejection frequencies of ink drop) and are binarized. The binarization procedure is carried out by comparing the chronological data with specific threshold values in the system controller 54 (step S303). The reason the binarization procedure is carried out is that noise is contained in the eight-bit chronological data related each frequency, therefore it is necessary to determine whether the data are related to noise or to a signal that corresponds to the ejection of ink drops. Using binarized data has the added advantage of facilitating inoperative nozzle detection and identification because each nozzle group is provided with a single bit of data.

The chronological binary data are retrieved and processed while ink drops are ejected from the cyan ink nozzle row C in FIG. 9 and while the print head 28 is moved at constant speed from right to left in the main scan direction MS. The condition shown in FIG. 9 is achieved immediately prior to time t3. Specifically, this is a condition in which nozzle No. 5, which belongs to the first nozzle group of cyan ink nozzle row C, has already left the sensing area of laser light L, and nozzle No. 9, which belongs to the first nozzle group of the same row, is about to enter the sensing area of laser light L. In this condition, nozzle Nos. 6–8 are within the sensing area of laser light L.

At time t1, nozzle detection signals appear in the first nozzle group when nozzle No. 1 of cyan ink nozzle row C enters the sensing area of laser light L, but the nozzle detection signals disappear when nozzle No. 1 leaves the sensing area. At time t2, nozzle No. 5 enters the sensing area, generating a nozzle detection signal that corresponds to this nozzle. Constant time intervals during which no nozzles are detected are thus generated immediately prior to time t2. It is believed that the same applies to the other nozzles (Nos. 9, 13–177) of the first nozzle group (from which ink drops are ejected at 5 kHz) and that nozzle detection signals appear in sequence during the constant time intervals during which no nozzles are detected. It can be seen in FIGS. 13A–13D that the same signals are generated by the nozzles belonging to the second to fourth nozzle groups.

This process yields nozzle detection signals whose number is equal to the number of operative nozzles belonging to the nozzle groups. Therefore, the difference between the number of nozzles belonging to the nozzle groups and the number of nozzle detection signals is equal to the number of inoperative nozzles. It can also be seen in FIGS. 9 and 13A–13D that when all the nozzles contained in the nozzle rows are operative, the nozzle detection signals appear in the following sequence: the first nozzle group, the second nozzle group, the third nozzle group, the fourth nozzle group, the first nozzle group, and so on.

In step S304, the system controller 54 monitors and identifies inoperative nozzles with the aid of such binary chronological data. When, for example, the inoperative nozzle is nozzle No. 1 in the first nozzle group, which is disposed in the end portion of the nozzle row, nozzle detection signals appear for the second nozzle group before they appear for the first nozzle group, as shown in FIGS. 14A–14D. If nozzle No. 1 were an operative nozzle, nozzle detection signals would first appear for the first nozzle group. This indicates that nozzle No. 1 is an inoperative nozzle. If nozzle No. 2 were also an inoperative nozzle, the nozzle detection signals would first appear for the third nozzle group rather than the second nozzle group. This indicates that nozzle No. 2 is operative nozzles.

Suppose nozzle No. 10, which belongs to a second nozzle group disposed in the middle of the nozzle row, is an inoperative nozzle, nozzle detection signals of the third nozzle group occasionally appear instead of the nozzle detection signals of the second nozzle group just after the nozzle detection signals of the first nozzle group in the chronological binary data. As a result, it can be concluded that the nozzles of the second nozzle group contain inoperative nozzles.

Inoperative nozzles may be identified by counting the nozzle detection signals of the third nozzle group for example, which does not have any inoperative nozzles. Specifically, it can be concluded that nozzle No. 10 is an inoperative nozzle because the presence of an inoperative nozzle has been detected in the second nozzle group, which precedes nozzle No. 11 (third nozzle). The absence of inoperative nozzles in the third nozzle group can be confirmed based on the agreement between the number of nozzles belonging to the third nozzle group and the number of nozzle detection signals detected for the third nozzle group.

Thus, an advantage of this embodiment is that inoperative nozzles can be identified without retesting each nozzle by chronologically comparing the nozzle detection signals of each nozzle group with each other. Another advantage is that the need to accurately measure the position of the carriage 29 can be dispensed with because the nozzles are tested by performing a mutual comparison based on a chronological series.

Theoretically, there may be cases in which inoperative nozzles cannot be identified when they are too numerous. The above sequence should still be applied, however, because the nozzle rows having inoperative nozzles should preferably be cleaned instead of the supplementary actions in such cases.

Although the second embodiment was described with reference to cases in which three test objects enter the sensing area of laser light L at the same time, it is also possible to apply an arrangement in which, for example, two test objects are in the sensing area. The number of target nozzles that can enter the sensing area of laser light L at the same time is commonly selected such that all the nozzles can eject ink drops at different frequencies.

F. Modifications

The present invention is not limited to the above-described embodiments or embodiments and can be implemented in a variety of ways as long as the essence thereof is not compromised. For example, the following modifications are possible.

F-1. Although the first embodiment was described with reference to a case in which ink drops were ejected from the target nozzles while the print head 28 remained stationary, it is also possible to apply an arrangement in which the ink drops are ejected while the print head 28 is in motion. The plurality of target nozzles should commonly be provided with drive signals for ejecting ink drops while the system generates a light beam that intersects at the same time the paths of ink drops concurrently ejected from the plurality of target nozzles.

When testing is performed while the print head 28 is in motion, the ejection of ink drops is controlled in accordance with the position of the carriage 29 measured by the linear encoder 35. The control procedure may be performed such that the ejection procedure starts when at least one of the target nozzles (Nos. 4–6 in FIG. 6) reaches a position in which ink drops can be ejected in the sensing area of laser light L, and stops when all the target nozzles (Nos. 4–6) reach an ink-ejecting position outside the sensing area.

A measurement trigger is sent from the system controller 54 to the missing dot detector 40 via the detector driver 64 (step S104 in FIG. 5) if all the target nozzles (Nos. 4–6) reach a position in which ink drops can be ejected within the sensing area. The other steps (S101, S102, S105–S107) are performed in the same manner as in the above embodiments.

F-2. Although the above embodiments were described with reference to a case in which inoperative nozzles were identified using a procedure in which digital data measured with a constant sampling period (for example, 50) were stored in memory or another storage element and these data were then analyzed, it is also possible to apply an arrangement in which the inoperative nozzles are tested at the same time as measurements are conducted during main scan. The inoperative nozzles may be tested during each main scan or after all of the test data has been acquired, for example.

F-3. The first embodiment may also be implemented by employing the filtering procedure used in the second embodiment. In this case, the nozzle detection signals are generated by a procedure in which, for example, the same frequency is used for all the drive signals sent to the plurality of target nozzles, and the detection pulses are filtered at this frequency. Comparing these nozzle detection signals with a specific threshold value makes it possible to determine whether the plurality of target nozzles contains inoperative nozzles.

Performing these operations also makes it possible to establish the presence or absence of inoperative nozzles in the same manner as in embodiment 1 above, but this arrangement is advantageous in the sense that the presence or absence of inoperative nozzles can be established with higher accuracy because the extraction process is limited solely to signals generated in accordance with the ejection of ink drops. As used herein, the term "threshold value" corresponds to the second threshold value referred to in the claims.

F-4. In the above embodiments, software can be used to perform some of the hardware functions, or, conversely, hardware can be used to perform some of the software functions.

F-5. The present invention can commonly be adapted to a printing device of the type in which ink drops are ejected, and to various printing devices other than color ink-jet printers. Examples include inkjet fax machines and copiers.

F-6. Although the print head of the above embodiments was described as having a plurality of nozzle rows aligned in the main scan direction, it is also possible to align the rows in the sub-scan direction.

What is claimed is:

1. A method for testing ejections of ink drops with a print head including a nozzle row having a plurality of nozzles, comprising the steps of:

(a) generating a light beam concurrently intersecting a plurality of paths of ink drops ejected from N target nozzles for the testing, N being an integer of 2 or more;

(b) providing the N target nozzles with drive signals to eject ink drops;

(c) generating detection pulses in response to blockage of the light beam by the ejected ink drops; and (d) detecting presence or absence of inoperable nozzle incapable of ejecting ink drops by analyzing the detection pulses based on the blockage of the light beam by the ejected ink drops.

2. The method in accordance with claim 1, further comprising the steps of:

updating the target nozzles by moving at least one of the print head and the light beam; and repeating the steps (a) to (d) until the testing is performed on all the plurality of nozzles.

3. The method in accordance with claim 2, wherein the step (d) includes the step of determining presence or absence of the inoperative nozzle among the N target nozzles if a value of a detection pulse is less than a predetermined first threshold value.

4. The method in accordance with claim 2, wherein the step (b) includes the step of setting a constant frequency for the drive signals; and the step (d) includes the steps of:

generating a nozzle detection signal by filtering out a component of the constant frequency from the detection pulses; and determining presence or absence of the inoperative nozzle among the N target nozzles if a value of the nozzle detection signal is less than a predetermined second threshold value.

5. The method in accordance with claim 2, further comprising the step of cleaning a nozzle row including the detected inoperative nozzle.

6. The method in accordance with claim 2, further comprising the steps of:

sequentially providing each of the N target nozzles with the drive signal one by one if the inoperative nozzle is detected among the N target nozzles;

generating detection pulses in response to blockage of the light beam by the ink drops ejected from each of the N target nozzles; and identifying the inoperative nozzle in response to the detection pulses.

7. The method in accordance with claim 2, wherein the step (b) includes the steps of:

setting N types of mutually different frequencies for the drive signals; and providing each of the N target nozzles with each of the N types of mutually different frequencies, respectively; and the step (d) includes the steps of:

filtering out N components of the N types of mutually different frequencies from the detection pulses;

generating nozzle detection signals as chronological data for each of the N components; and identifying the inoperative nozzle among the N target nozzles by comparing an time order of the nozzle detection signals in the chronological data.

8. The method in accordance with claim 7, wherein the N types of ejection frequencies are set such that any multiples of the N types of mutually different frequencies is different from any of the N types of mutually different frequencies.

9. The printing apparatus in accordance with claim 8, wherein the inoperative nozzle detector determines presence or absence of the inoperative nozzle ink drops among the N target nozzles if a value of a detection pulse is less than a predetermined first threshold value.

10. The printing apparatus in accordance with claim 8, wherein the drive signal generator is further capable of setting a constant frequency for the drive signals; and the inoperative nozzle detector is further capable of:

generating a nozzle detection signal by filtering out a component of the constant frequency from the detection pulses; and determining presence or absence of the inoperative nozzle among the N target nozzles if a value of the nozzle detection signal is less than a predetermined second threshold value.

11. The printing apparatus in accordance with claim 8, further comprises a nozzle cleaning mechanism configured to clean a nozzle row including the detected inoperative nozzle.

12. The printing apparatus in accordance with claim 8, wherein the drive signal generator is further capable of sequentially providing each of the N target nozzles with the drive signal one by one if the inoperative nozzle is detected among the N target nozzles; and the inoperative nozzle detector is further capable of identifying the inoperative nozzle in response to the detection pulses.

13. The printing apparatus in accordance with claim 12, the N types of ejection frequencies are set such that any multiples of the N types of mutually different frequencies is different from any of the N types of mutually different frequencies.

14. The printing apparatus in accordance with claim 8, wherein the drive signal generator is further capable of:

setting N types of mutually different frequencies for the drive signals; and providing each of the N target nozzles with each of the N types of mutually different frequencies, respectively; and the inoperative nozzle detector is further capable of:

filtering out N components of the N types of mutually different frequencies from the detection pulses;

generating nozzle detection signals as chronological data for each of the N components; and identifying the inoperative nozzle among the N target nozzles by comparing an time order of the nozzle detection signals in the chronological data.

15. A printing apparatus, comprising:

a print head including a nozzle row having a plurality of nozzles for ejecting ink drops;

a light beam generator configured to generate a light beam concurrently intersecting a plurality of paths of ink drops ejected from N target nozzles for the testing, N being an integer of 2 or more;

a drive signal generator configured to provide the N target nozzles with drive signals to eject ink drops;

a detection pulse generator configured to generate detection pulses in response to blockage of the light beam by the ejected ink drops;

an inoperative nozzle detector configured to detect presence or absence of inoperable nozzle incapable of ejecting ink drops by analyzing the detection pulses based on the blockage of the light beam by the ejected ink drops; and a test nozzle updater configured to update the target nozzles by moving at least one of the print head and the light beam.

* * * * *